US005846346A

United States Patent [19]

Lee et al.

[11] Patent Number: 5,846,346

[45] Date of Patent: Dec. 8, 1998

[54] HIGH STRENGTH HIGH CONDUCTIVITY CU-ALLOY OF PRECIPITATE GROWTH SUPPRESSION TYPE AND PRODUCTION PROCESS

[75] Inventors: Dong Woo Lee, Kyungsangnam-Do; In Dal Kim, Kyungki-Do, both of Rep. of Korea

[73] Assignee: Poongsan Corporation, Kwangyeok-si, Rep. of Korea

[21] Appl. No.: 756,358

[22] Filed: Nov. 26, 1996

[30] Foreign Application Priority Data

Dec. 8, 1995 [KR] Rep. of Korea ..... 1995/48017

[51] Int. Cl.[6] ..... C22C 9/02

[52] U.S. Cl. ..... 148/433; 148/554; 148/685

[58] Field of Search ..... 148/554, 685, 148/433; 420/470, 473

[56] References Cited

FOREIGN PATENT DOCUMENTS 362227052 10/1987 Japan .
363093836 4/1988 Japan .
2-170937 7/1990 Japan .
3-188247 8/1991 Japan .
6-41660 2/1994 Japan .

*Primary Examiner*—Sikyin Ip
*Attorney, Agent, or Firm*—Jacobson, Price, Holman & Stern, PLLC

[57] ABSTRACT

This invention relates to a high strength, high electrical conductivity copper alloy having excellent mechanical and physical properties, including thermal softening resistance, in which precipitate particles are finely dispersed (growth of the precipitate is suppressed), and the production process. The alloy is the precipitation suppressed copper alloy consisted of 0.5~4.0 wt % nickel, 0.1~1.0 wt % silicon, 0.05~0.8 wt % tin (Sn) and balance copper and inevitable impurities, wherein sizes of precipitate particles are below 0.5 μm. The production process includes the steps of melting and casting raw materials, surface machining and cold rolling of the ingot, subjecting the cold rolled ingot to a precipitation process at a temperature ranging 450~520 deg. C. for 5~12 hours, cold rolling the precipitation processed material, and subjecting the cold rolled material to a tension annealing process at a temperature ranging 350~550 deg. C. for below 90 seconds.

9 Claims, 5 Drawing Sheets

HIGH STRENGTH HIGH CONDUCTIVITY CU-ALLOY OF PRECIPITATE GROWTH SUPPRESSION TYPE AND PRODUCTION PROCESS

BACKGROUND OF THE INVENTION

1. Field of the Invention

This invention relates to a high strength, high conductivity copper alloy of Cu—Ni—Si group, more particularly, to a high conductivity copper alloy having excellent mechanical and physical properties, including thermal softening resistance, in which precipitate particles are finly dispersed (growth of the precipitate is suppressed), and to a good method, in which any solid solution treatment may not be required, so as not to require any solution treatment.

2. Discussion of the Related Art

A copper base alloy is required to have high electrical conductivity and mechanical strength for applications to lead frames of electronic components, such as semiconductor IC, and LSI as well as high strength electrical components. A semiconductor lead frame, being a component that takes the most important role in an IC packaging and fabricated of a roll of thin sheet by stamping or chemical etching, maintains configuration of elements during assembly and becomes a part of an integrated circuit after molding. After the molding, legs of the lead frame are coated with tin/lead for surface stabilization.

As some of recent semiconductor components are used at a temperature over 100 deg. C, thermal stability becomes very important. What are required as material properties for applications to connectors including semiconductor lead frames are high electrical and thermal conductivities, excellent thermal softening resistance, good electroplatability and soderability. Particularly, as semiconductor packaging process is automated, demands on higher strength material is increasing.

The most well known material of C7025 (Cu—Ni—Si—Mg) from Olin has difficulties in preparation due to its non-uniform composition and increased viscosity of the melt come from oxidation loss of the 0.15 wt % Mg contained therein during melting. In the meantime, of the precipitation hardening alloys, Corson group alloys (Ni 0.5~4.0 wt %, Si 0.1~1.0 wt % and Cu the balance) are the most well known, and a material is also suggested in JP publication No. S60-45698 by Nihon Kougyo.

The material of above S60-45698 is suggested to produce from Cu—Ni—Si or with 14 selected additives to have a precipitate particle size of 1~5 $\mu$m, with a production process of hot rolling of an ingot (solution treatment) at 800 deg. C, surface machining, cold rolling, annealing at 800 deg. C, cold rolling, and aging for 6 hours at 420 deg. C. However, from its major objectives laid on improvement in anti-corrosion and strength and distribution of large sized precipitate particles, the aforementioned suggestion S60-45698 is not on suppression of precipitation and growth, and requires solution treatment which is a factor of cost push. The precipitation hardening Corson group alloys are known to be improved of its strength and electrical conductivity by aging, for which the solution treatment is pre-requisite.

SUMMARY OF THE INVENTION

Accordingly, the present invention is directed to a high strength, high conductivity copper alloy and a method for producing the copper alloy that substantially obviates one or more of the problems due to limitations and disadvantages of the related art.

An object of the present invention is to provide a high conductivity copper alloy having excellent mechanical and physical properties, including thermal softening resistance, in which precipitate particles are finely dispersed (growth of the precipitate is suppressed).

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the high strength and high conductivity copper alloy of precipitate growth suppression type consists of 0.5~4.0 wt % nickel, 0.1~1.0 wt % silicon, 0.05~0.8 wt % tin (Sn) and balance copper and inevitable impurities, wherein sizes of precipitate particles are below 0.5 $\mu$m.

In another aspect, the present invention provides a process for preparing a high strength and high conductivity copper alloy including the steps of melting and casting raw materials to obtain an ingot consisting of 0.5~4.0 wt % nickel, 0.1~1.0 wt % silicon, 0.05~0.8 wt % tin (Sn) and balance copper and inevitable impurities, surface machining and cold rolling of the ingot, subjecting the cold rolled ingot to a precipitation process at a temperature ranging 450~520 deg. C. for 5~12 hours, cold rolling the precipitation processed material, and subjecting the cold rolled material to a tension annealing process at a temperature ranging 350~550 deg. C. for below 90 seconds.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the drawings.

In the drawings.

DETAILED DESCRIPTION OF THE PREFERRED EMBODIMENT

Figure 1:
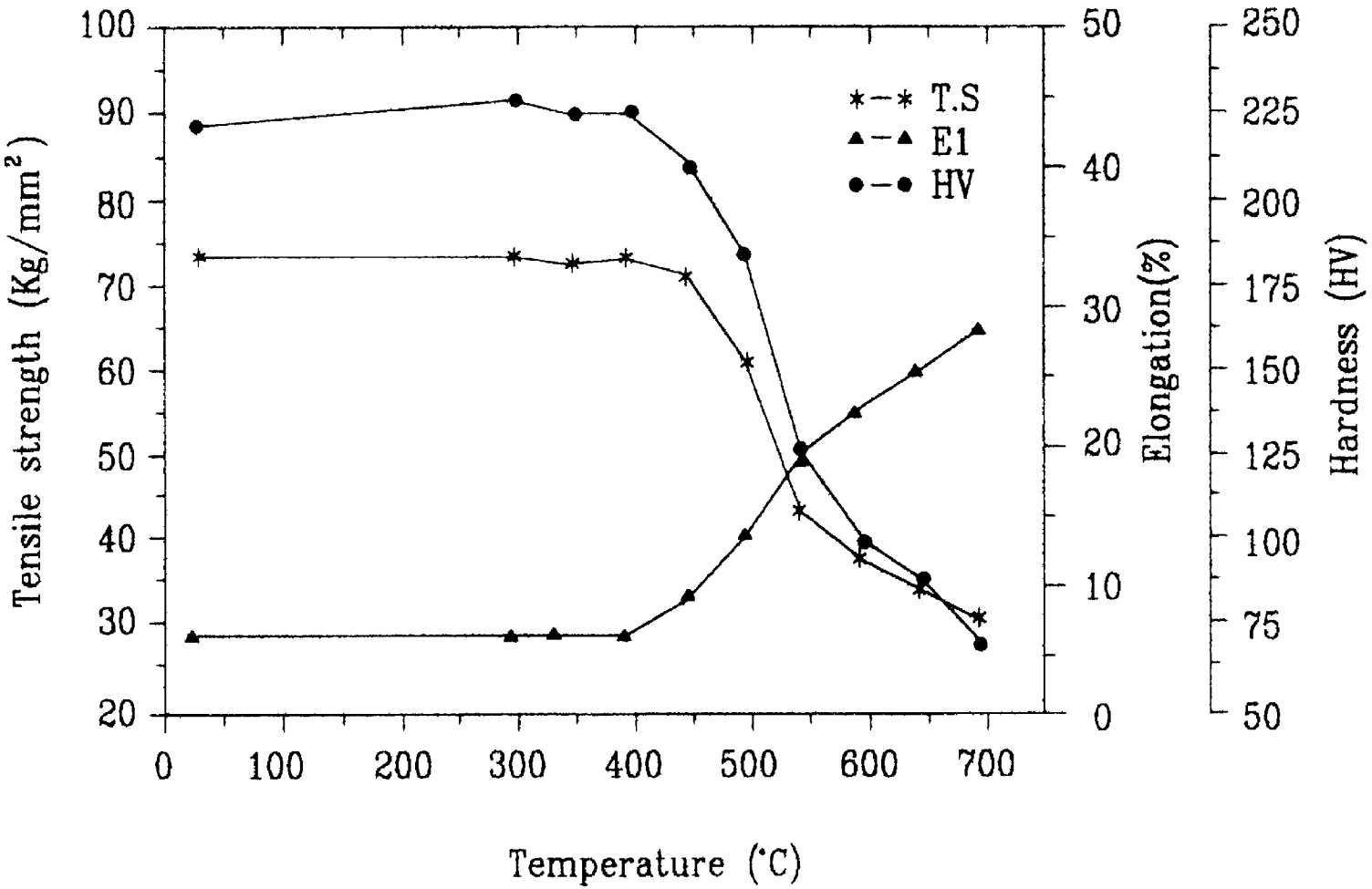
FIG. 1 illustrates mechanical properties vs. temperature curves of a copper alloy in accordance with the present invention.

Reference will now be made in detail to the preferred embodiments of the present invention, examples of which are illustrated in the accompanying drawings.

The high strength, high conductivity copper alloy in accordance with the present invention consists of nickel (Ni) 0.5~4.0 wt %, silicon (Si) 0.1~1.0 wt %, tin (Sn) 0.05~0.8 wt %, and the balance of copper with inevitable impurities, with a distribution of precipitate particle sized below 0.5 $\mu$m. Of the aforementioned composition, Cu—Ni—Si group alloy is known as Corson group alloy. Accordingly, explanations on the Ni and Si composition will be omitted.

According to the present invention, a Corson group alloy is added with 0.05~0.8 wt % Sn to suppress growth of precipitate, resulting to finely disperse the precipitates. If the addition of Sn is below 0.05 wt %, there is no effect of the fine dispersion, and if it is over 0.8 wt %, there is not so much effect of the fine dispersion compared to the amount of addition and may exhibit a lower conductivity.

One of the features of the present invention is on placing a limitation of the precipitate particle size below 0.5 $\mu$m. With this fine precipitate particles, particle density becomes high in overall. According to this, the copper alloy of the present invention has good solderability and electroplatability, and, in connection with fine dispersed precipitation, has excellent machinability, thermal softening resistance and high strength related to spring strength. Particularly, the alloy of the present invention can have its precipitation driving force in the following process identical to a material having subjected to a solution treatment without any such treatment.

A method for preparing the high strength, high conductivity copper alloy in accordance with the present invention will be explained.

Cu—Ni—Si—Sn are melted and refined to obtain the aforementioned composition. During this refining, Zn below 1.0 wt %, and P, Mg, Zr each up to 0.1 wt % may be added as deoxidizers. In this time, Zn is added as an ingot, P is added as CuP 15, Mg is added as CuMg 10, and Zr is added as CuZr 50, during melting. Of the composition, Ni may be replaced with Fe or Co up to 1 wt %. The composition of the present invention, limited within a range to assure an electrical conductivity higher than 40% IACS, may contain inevitable impurities other than the above elements up to 0.05 wt % as far as the impurities do not adversely affect the electrical conductivity.

A melt having prepared as such is casted to obtain an ingot. The ingot is then, surface machined, cold rolled down to a predetermined thickness, subjected to precipitation process for 5~12 hours at a temperature range of 450~520 deg. C, cold rolled, and subjected to tension annealing process for below 90 seconds at a temperature range of 350~550 deg. C.

An important feature of the aforementioned production process is the capability of omission of the solution treatment process which is essential in production of a precipitation hardening alloy. That is, with the suppression of precipitation and subsequent growth of $Ni_2Si$ during solidification of melt by the Sn dissolved in a base, a precipitation driving force at the time of precipitation annealing process becomes identical to a material which has been solution treated even if solution treatment of the ingot within a particular temperature range is omitted. This production method can be applicable to materials of Mg containing C7025 of Olin and of Korean Patent publication No. 94-10455 (PMC 102M).

The reason of providing conditions in the precipitation process (450~520 deg. C, 5~12 hours) and tension annealing is as follows.

In case the copper alloy of the present invention has been subjected to aging at a temperature below 450 deg. C, though a precipitation strength can be assured with ease due to the effect of precipitate growth suppression by the added Sn, since a prolonged aging of more than 12 hours is required for assuring ductility, bendability and toughness for applications to connectors, the copper alloy of the present invention may not be favorable in view of productivity and may have a low electrical conductivity due to inadequate precipitation conditions (the precipitation driving force is too low.).

If the aging temperature is coming over 520 deg. C, the copper alloy exhibits a sharp drop of electrical conductivity due to re-solid solution of the precipitates, together with a decrease of a thermal softening resistance due to loss of the precipitation hardening effect coming from the tendency of precipitate particles becoming coarse.

If the temperature is too low (below 350 deg. C) in case of the tension annealing (350~550 deg. C, within 90 seconds), since the driving force is not so enough, that dislocation may not be forced to move and fix at a particular spot within a short time. It is hard to expect any tension annealing effect. Accordingly, it causes difficulty in securing a required spring strength. If the temperature is coming over 550 deg. C, since a sharp change of physical properties within a short time happens, a control over the tension annealing time is hardly feasible, which causes degradation of elasticity and strength.

The present invention will be explained according to preferred embodiments.

FIRST EMBODIMENT

The melting and casting of the copper alloy of the present invention are done under the atmosphere. In case the copper alloy is strip casted (thickness<25 mm: vertical semi-continuous casting or horizontal continuous casting), the casted material is subjected to precipitation annealing process after cold rolling without any solution treatment. However, in case the copper alloy is vertical continuous casted (VCC), the casted material is hot rolled before the cold rolling considering a thickness of the slab.

The alloy of the first embodiment is, melted and casted from a material having a chemical composition shown in TABLE 1, surface machined without subjecting to solution treatment, and cold rolled down to 1.5 mm thickness. Then, the cold rolled material is subjected to precipitation process for 5~12 hours within a temperature range of 450~520 deg. C, and cold rolled down to 0.254 mm. The cold rolled material is subjected to a tension annealing process for below 90 seconds within a temperature range of 350~550 deg. C. to secure a spring strength over 40 Kg/mm$^2$. A section of completed product is viewed under an electron microscope and sizes of the precipitate are measured to find them maximum 0.3~0.4 $\mu$m. The results are shown in TABLE 1 below.

TABLE 1

| | Chemical composition (WT %) | | | | | | | 1* | 2* | 3* | 4* | 5* | 6* | | |
|---|---|---|---|---|---|---|---|---|---|---|---|---|---|---|---|
| alloy | Ni | Si | Sn | P | Mg | Zn | Cu | (μm) | (TS) | (El) | (HV) | (EC) | (Kb) | 7* | 8* |
| THE PRESENT INVENTION | | | | | | | | | | | | | | | |
| 1 | 1.2 | 0.3 | 0.2 | 0.03 | | | THE BAL-ANCE | <0.5 | 60 | 8 | 175 | 50 | 41 | 470° C./ 10 h | 400° C./ 90 s |
| 2 | 1.5 | 0.3 | 0.2 | | | | | <0.5 | 62 | 7 | 190 | 55 | 43 | 490° C./ 12 h | 450° C./ 60 s |
| 3 | 1.5 | 0.3 | 0.3 | | | | | <0.5 | 63 | 7 | 194 | 52 | 41 | 480° C./ 12 h | 540° C./ 45 s |
| 4 | 1.5 | 0.4 | 0.1 | | | | | <0.5 | 63 | 8 | 195 | 57 | 44 | 490° C./ 12 h | 460° C./ sec |
| 5 | 1.5 | 0.2 | 0.2 | | | 0.4 | | <0.5 | 60 | 8 | 182 | 52 | 43 | 480° C./ 12 h | 450° C./ 60 s |
| 6 | 1.5 | 0.4 | 0.2 | | | 0.4 | | <0.5 | 64 | 8 | 196 | 50 | 48 | 490° C./ 12 h | 480° C./ 80 s |
| 7 | 1.5 | 0.3 | 0.05 | | 0.05 | 0.1 | | <0.5 | 62 | 10 | 190 | 55 | 41 | 490° C./ 12 h | 450° C./ 60 s |
| 8 | 1.5 | 0.3 | 0.05 | 0.06 | | 0.3 | | <0.5 | 60 | 10 | 184 | 52 | 43 | 490° C./ 12 h | 470° C./ 45 s |
| 9 | 2.0 | 0.4 | 0.2 | | | | | <0.5 | 66 | 8 | 200 | 50 | 52 | 500° C./ 10 h | 500° C./ 60 s |
| 10 | 2.0 | 0.4 | 0.4 | | | | | <0.5 | 70 | 7 | 214 | 48 | 54 | 490° C./ 12 h | 520° C./ 45 s |
| 11 | 3.0 | 0.75 | 0.2 | | | | | <0.5 | 75 | 7 | 242 | 40 | 40 | 510° C./ 12 h | 500° C./ 60 s |
| 12 | 4.0 | 1.0 | 0.2 | | | | | <0.5 | 77 | 7 | 250 | 41 | 62 | 520° C./ 10 h | 500° C./ 80 s |
| COMPARED | | | | | | | | | | | | | | | |
| 13 | 1.7 | 0.35 | 0.51 | | | | | 3 | 72 | 11 | 222 | | | | Nihon |
| 14 | 1.9 | 0.47 | 0.05 | 0.01 | | | | 1 | 68 | 12 | 206 | | | | Kogyo |
| 15 | 1.5 | 0.35 | | | | | | 4 | 66 | 11 | 203 | | | | Pat. |
| 16 | 1.65 | 0.42 | | | | 0.3 | | 1 | 67 | 12 | 265 | | | | |
| 17 | 1.63 | 0.39 | | | 0.06 | | | 2 | 69 | 11 | 218 | | | | |
| 18 | 1.7 | 0.35 | 0.5 | | | | | 6 | 55 | 5 | 167 | | | 9* | 9* |

*(Ts,.Kb: kg/mm$^2$, EC: %, IACS, EL: %)
1*: size of precipitate
2*: tensile strength
3*: eldrigation
4*: hardness
5*: electrical conductivity
6*: spring limit
7*: precipitated conditions
8*: tension annealed conditions
9*: identical composition to 13

In the case of compared alloys 13~18 in TABLE 1, the sizes of precipitates shown are over 1 μm which are sizes impracticable in an actual production process, because it requires a long time (more than 20 hours) and high temperature to produce such coarse precipitate particles, in which case the electrical conductivity as well as strength and hardness are dropped sharply due to re-solid solution of unstable fine precipitates into matrix. Moreover, the more coarser the size of precipitates, the worse the solderability and electroplatability (That is, as disclosed in JP J1603381 by Nihon Kougyo, with solution treatment at 800 deg. C. and precipitate process at 420 deg. C. for 6 hours, the aforementioned conditions can not be met.).

In order to measure a thermal softening resistance that is required for applications to a connector material, the No. 10 alloy in TABLE 1 is measured of its change in tensile strength after subjecting it to annealing in 300 deg. C~700 deg. C. range for 30 minutes and air cooling. The resulting graph of the heat softening resistance measurements is shown in FIG. 1. The graph shows that a tensile strength over 80% of an initial tensile strength can be maintained up to about 500 deg. C. by the precipitate growth suppression effect.

SECOND EMBODIMENT

Figure 2:
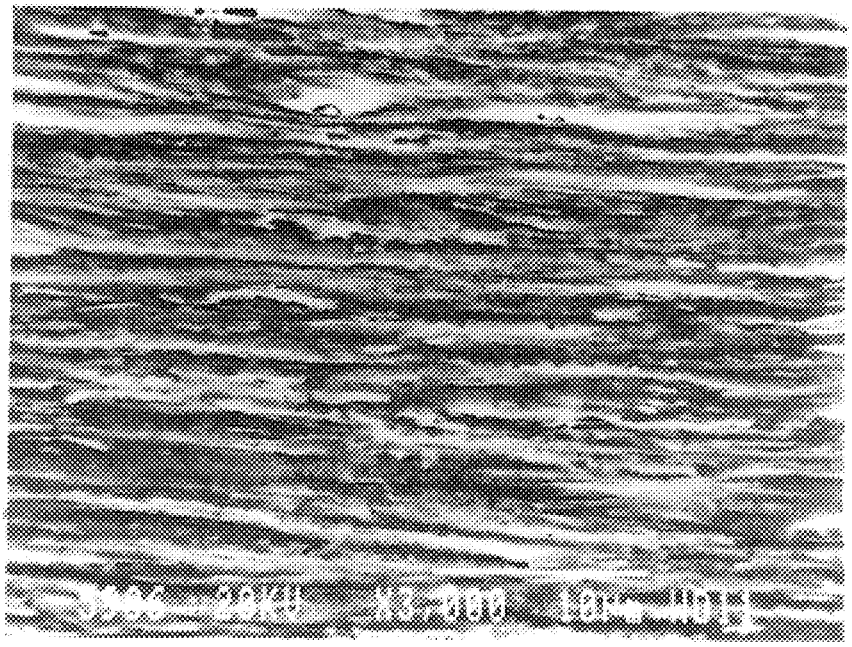
FIG. 2 illustrates a microscopic view (mag. 3000) of a cold rolled, non-solution treated section of a copper alloy in accordance with the present invention.
Figure 3:
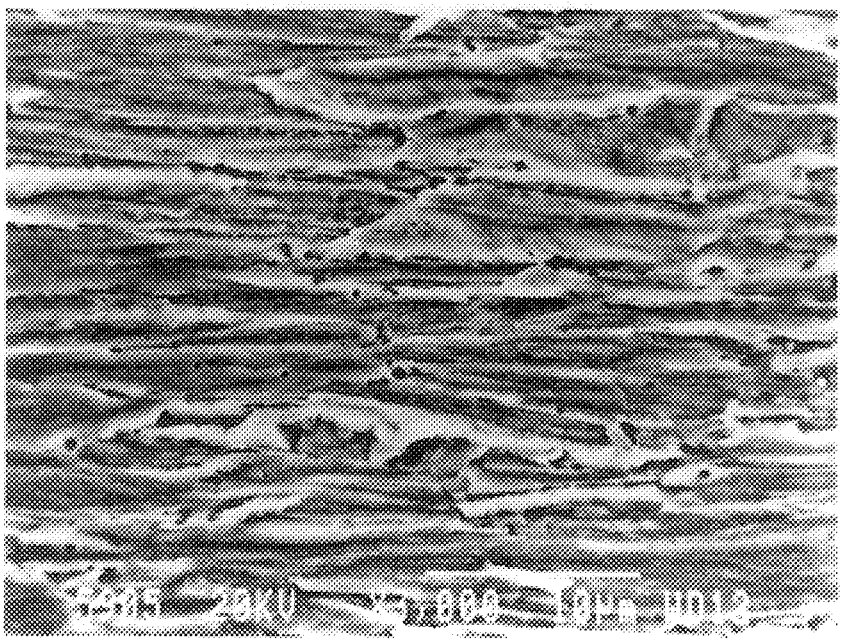
FIG. 3 illustrates a microscopic view (mag. 3000) of a cold rolled, solution treated section of a copper alloy in accordance with the present invention.

The embodiments shown below illustrate microscopic views of precipitate distributions between process steps in the first embodiment using sample 10 in TABLE 1. FIG. 2 illustrates a material casted and cold rolled without solution treatment, and FIG. 3 illustrates a material casted, solution treated and cold rolled. As can be seen from those photographs, no precipitates can be found in the matrix. Therefore, it was expected that a sufficient precipitation can occur (due to over saturation of the solute element) when Sn is added even if solution treatment is omitted, which is verified as the following.

Figure 4:
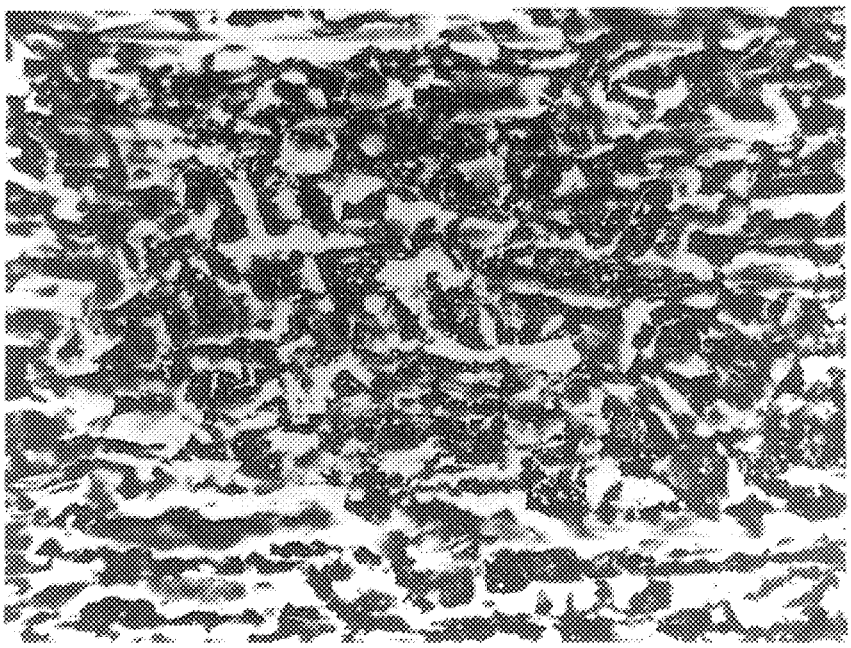
FIG. 4 illustrates a microscopic view of the copper alloy of FIG. 2 showing distribution of precipitates after aging.
Figure 5:
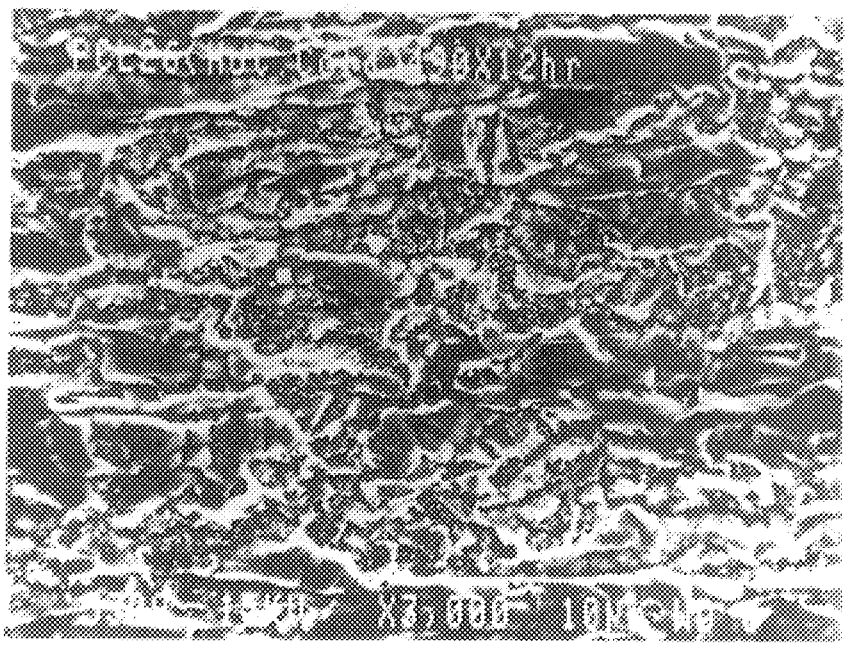
FIG. 5 illustrates a microscopic view of the copper alloy of FIG. 3 showing a distribution of precipitates after aging.

FIGS. 4 and 5 illustrate microscopic views of the materials in FIGS. 2 and 3 respectively after being subjected to precipitation process for 12 hours at 490 deg. C. for showing distributions of precipitates for comparison purpose, wherein the white spots indicate the coarse precipitates.

Thus, without any solution treatment, a sufficient precipitation could be made to occur with the solid solution element diffusion blocking effect coming from the addition of Sn. A physical property comparison of this result is shown in TABLE 2 below.

TABLE 2

| | process | tensile strength(Kg/mm$^2$) | elongation (%) | hardness (HV) | electrical conductivity (%) |
|---|---|---|---|---|---|
| no solution treated | casted | — | — | 104 | 24 |
| | cold rolled 1.5 mm | 56 | 4 | 166 | 23 |
| | precipitated 490 × 12 hrs | 50 | 20 | 160 | 49 |
| solution treated | casted | — | — | 104 | 24 |
| | cold rolled 1.5 mm | 54 | 6 | 164 | 24 |
| | precipitated 490 × 12 hrs | 51 | 19 | 151 | 49 |

Of the precipitation effects of changes in strength and electrical conductivity of a precipitation hardened alloy, the strength shows its maximum when precipitate particles are coherent with matrix after the precipitation, but not fully grown yet. On the contrary, the electrical conductivity shows its maximum when fully grown precipitate particles are incoherent with the matrix. Accordingly, in comparison of FIGS. 4 and 5, though the distributions of precipitates are similar, from the finer structure of the material shown in FIG. 4, it can be known that the mechanical properties of the material shown in FIG. 4 is better than the material shown in FIG. 5 though their electrical conductivity are similar (since the amounts which can be precipitated under the same condition are the same).

Figure 6:
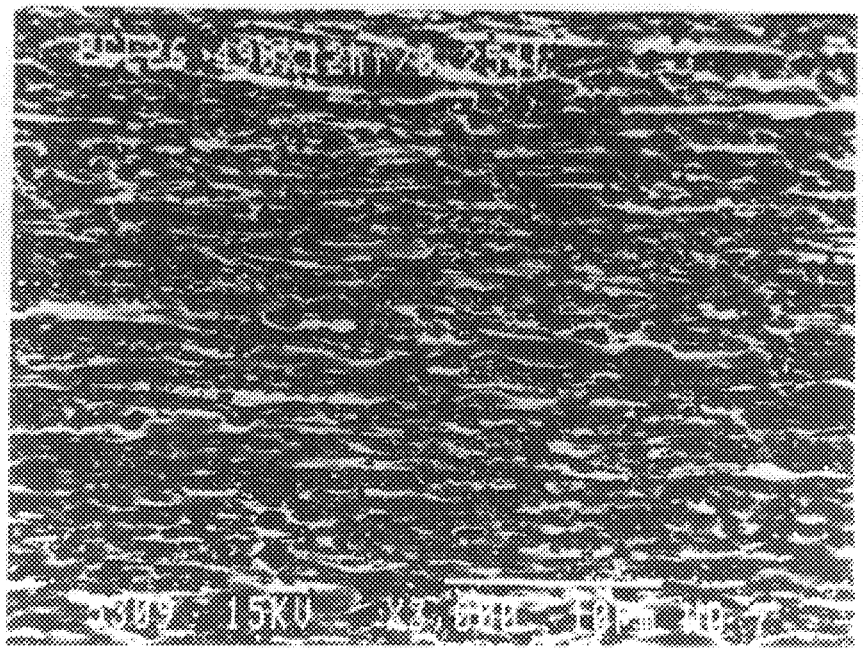
FIG. 6 illustrates a microscopic view of the copper alloy of FIG. 4 showing size and distribution of precipitates after cold rolling.
Figure 7:
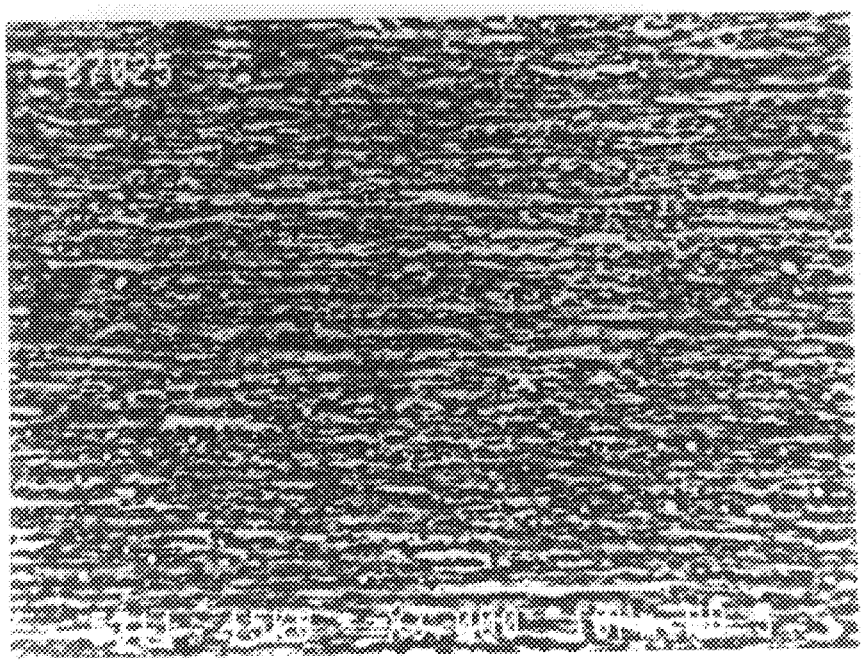
FIG. 7 illustrates a microscopic view of C7025 alloy of Olin showing size and distribution of precipitates.

FIG. 6 illustrates a sectional microscopic view of the material shown in FIG. 4 after subjected to cold rolling down to a thickness of 0.254 mm and tension annealing at 500 deg. C for 60 seconds, and FIG. 7 illustrates a sectional microscopic view of C7025 alloy of Olin. As can be seen, the structure of the material of the present invention (FIG. 6) is also fine.

Figure 8:
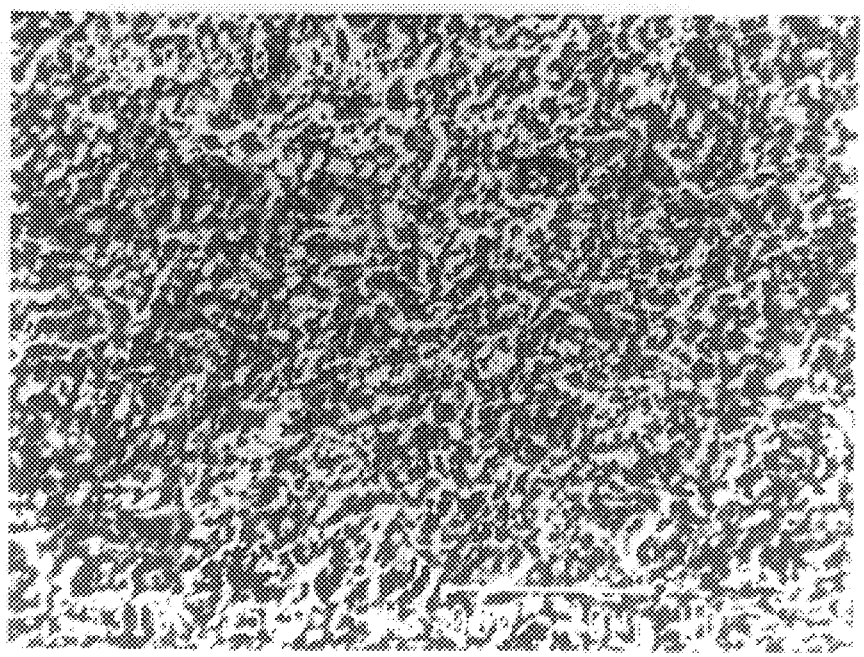
FIG. 8 illustrates a microscopic view of PMC 102 alloy showing size and distribution of precipitates; and, FIG. 9 illustrates a microscopic view of CC101 alloy showing size and distribution of precipitates.
Figure 9:
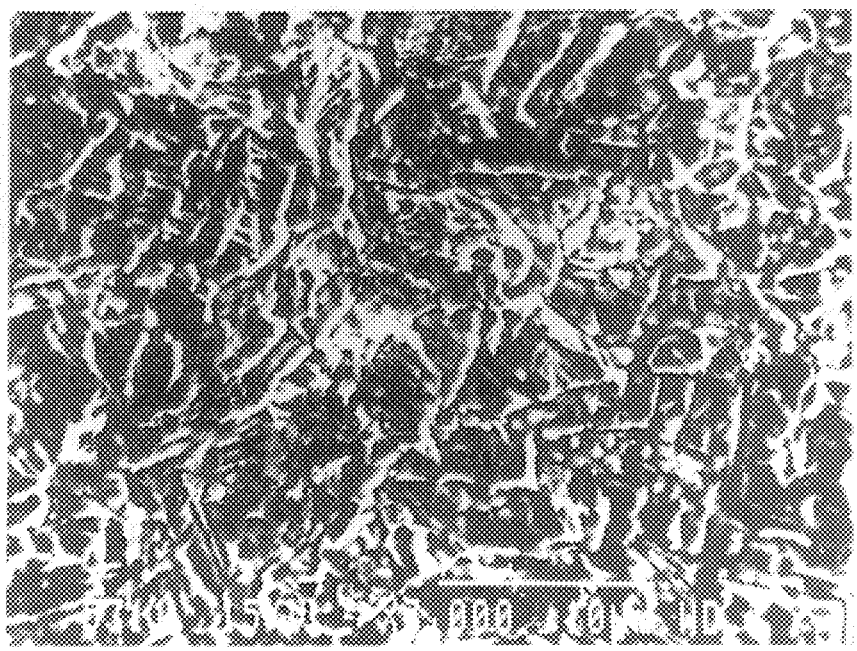

FIGS. 8 and 9 are sectional microscopic views of PMC 102 alloy and JP S60-45698 alloy by Nihon Kougyo respectively, wherein it can be found that coarse precipitates are not seen as frequent as the present invention. TABLE 3 shows the sizes and distributions of the precipitated material shown in FIGS. 6~8.

TABLE 3

| sample | measurement No. | No. of particles/100 $\mu m^2$ | average No. of particles/100 $\mu m^2$ | density of particles/$\mu m^2$ |
|---|---|---|---|---|
| Alloy of the present invention Cu-2Ni-0.4Si-0.4Sn | 1 | 23 | 23.5 | 0.235 |
| | 2 | 32 | | |
| | 3 | 24 | | |
| | 4 | 23 | | |
| | 5 | 19 | | |
| | 6 | 20 | | |
| C7025(Olin) Cu-3Ni-0.65Si-0.15 Mg | 1 | 12 | 13.5 | 0.135 |
| | 2 | 7 | | |
| | 3 | 13 | | |
| | 4 | 18 | | |
| | 5 | 14 | | |
| | 6 | 17 | | |
| CC101(Nihon Kougyo) Cu-1.6Ni-0.4Si-0.4Zn | 1 | 2.5 | 2.5 | *1 0.025 |
| PMC102 (PoongSan) Cu-1.5Ni-0.3Si- | 1 | 21 | 16.7 | 0.167 |
| | 2 | 17 | | |
| | 3 | 18 | | |

TABLE 3-continued

| sample | measurement No. | No. of particles/100 $\mu m^2$ | average No. of particles/100 $\mu m^2$ | density of particles/$\mu m^2$ |
|---|---|---|---|---|
| 0.03P | 4 | 16 | | |
| | 5 | 15 | | |
| | 6 | 13 | | |

It will be apparent to those skilled in the art that various modifications and variations can be made in method for fabricating semiconductor device of the present invention without departing from the spirit or scope of the invention. Thus, it is intended that the present invention cover the modifications and variations of this invention provided they come within the scope of the appended claims and their equivalents.

What is claimed is:

1. A high strength and high electrical conductivity copper alloy of precipitate growth suppression consisting of 0.5~4.0 wt % nickel, 0.1~1.0 wt % silicon, 0.05~0.8 wt % tin (Sn) and balance copper and inevitable impurities, wherein sizes of precipitate particles are below 0.5 $\mu$m, and a density of precipitate particles is in a range of 19–24 per 100 $\mu m^2$.

2. A process for producing a high strength and high electrical conductivity copper alloy without a step of solution treatment, comprising the steps of:

melting and casting raw material to obtain an ingot consisting of 0.5~4.0 wt % nickel, 0.1~1.0 wt % silicon, 0.05~0.8 wt % tin (Sn) and balance copper and inevitable impurities;

surface machining and cold rolling of the ingot;

subjecting the cold rolled ingot to a precipitation process at a temperature ranging 450~520 deg. C. for 5~12 hours;

cold rolling the precipitation processed material; and subjecting the cold rolled material to a tension annealing process at a temperature ranging 350~550 deg. C. for below 90 seconds, wherein sizes of precipitate particles are below 0.5 $\mu$m, and a density of precipitate particles is in a range of 19–24 per $\mu m^2$.

3. A process as claimed in claim 2, wherein Zn below 1.0 wt %, and P, Mg, Zr each up to 0.1 wt % are added as deoxidizers during the melting step.

4. A high strength and high electrical conductivity copper alloy of precipitate growth suppression consisting of 0.5~3.0 wt % nickel, up to 1 wt % iron, 0.1~1.0 wt % silicon, 0.05~0.8 wt % tin (Sn) and balance copper and inevitable impurities, wherein sizes of precipitate particles are below 0.5 $\mu$m and a density of precipitate particles is in a range of 19–24 per 100 $\mu m^2$.

5. A high strength and high electrical conductivity copper alloy of precipitate growth suppression consisting of 0.5~3.0 wt % nickel, up to 1 wt % cobalt, 0.1~1.0 wt % silicon, 0.05~0.8 wt % tin (Sn) and balance copper and inevitable impurities, wherein sizes of precipitate particles are below 0.5 $\mu$m and a density of precipitate particles is in a range of 19–24 per 100 $\mu m^2$.

6. A process for producing a high strength and high electrical conductivity copper alloy without a step of solution treatment, comprising the steps of:

melting and casting raw material to obtain an ingot consisting of 0.5~3.0 wt % nickel, up to 1 wt % iron, 0.1~1.0 wt % silicon, 0.05~0.8 wt % tin (Sn) and balance copper and inevitable impurities;

surface machining and cold rolling of the ingot;

subjecting the cold rolled ingot to a precipitation process at a temperature ranging 450~520 deg. C. for 5~12 hours;

cold rolling the precipitation processed material; and subjecting the cold rolled material to a tension annealing process at a temperature ranging 350~550 deg. C. for below 90 seconds, wherein sizes of precipitate particles are below 0.5 $\mu$m, and a density of precipitate particles is in a range of 19–24 per $\mu m^2$.

7. A process as claimed in claim 6, wherein Zn below 1.0 wt %, and P, Mg, Zr each up to 0.1 wt % are added as deoxidizers during the melting step.

8. A process for producing a high strength and high electrical conductivity copper alloy without a step of solution treatment, comprising the steps of:

melting and casting raw material to obtain an ingot consisting of 0.5~3.0 wt % nickel, up to 1 wt % cobalt, 0.1~1.0 wt % silicon, 0.05~0.8 wt % tin (Sn) and balance copper and inevitable impurities;

surface machining and cold rolling of the ingot;

subjecting the cold rolled ingot to a precipitation process at a temperature ranging 450~520 deg. C. for 5~12 hours;

cold rolling the precipitation processed material; and subjecting the cold rolled material to a tension annealing process at a temperature ranging 350~550 deg. C. for below 90 seconds, wherein sizes of precipitate particles are below 0.5 $\mu$m, and a density of precipitate particles is in a range of 19–24 per $\mu m^2$.

9. A process as claimed in claim 8, wherein Zn below 1.0 wt %, and P, Mg, Zr each up to 0.1 wt % are added as deoxidizers during the melting step.

* * * * *